United States Patent [19]

Melanson

[11] 4,012,023

[45] Mar. 15, 1977

[54] GRID CLIP APPARATUS FOR HANGING PICTURES

[75] Inventor: James W. Melanson, Concord, N.H.

[73] Assignee: The Raymond Lee Organization, Inc., a part interest

[22] Filed: Mar. 17, 1976

[21] Appl. No.: 667,477

[52] U.S. Cl. ..... 248/489

[51] Int. Cl.[2] ..... A47G 1/16

[58] Field of Search ..... 248/317, 328, 489, 492, 248/493, 494, 495, 496

[56] References Cited

UNITED STATES PATENTS

| | | | |
|---|---|---|---|
| 737,234 | 8/1903 | Hill | 248/497 |
| 752,622 | 2/1904 | Kitzmiller | 248/496 |
| 861,142 | 7/1907 | Rynek | 248/493 |
| 1,883,834 | 10/1932 | Turner | 248/494 |
| 2,299,443 | 10/1942 | Walmsley | 248/497 |
| 2,757,890 | 8/1956 | Sutton et al. | 248/494 |

*Primary Examiner*—William H. Schultz

[57] ABSTRACT

A two-piece clip is used for hanging pictures and the like. One piece of the clip is attached to the back of a picture, and has a downwardly and rearwardly extending flange. The second piece, called a hook, engages the flange with a U-shaped portion, and is attached to the lower end of a wire or the like to hold the picture up. The upper end of the wire is secured to a second clip which in turn engages the metal border surrounding suspended ceilings of either grid or intergrid types.

2 Claims, 6 Drawing Figures

GRID CLIP APPARATUS FOR HANGING PICTURES

This invention is a new type of clip system for hanging pictures and the like from suspended ceiling metal border framework. One clip has a first piece which engages the rear of the picture and a second detachable piece which engages the first piece and is attached to the lower end of a vertical wire or the like. The upper end of the wire is secured to a second clip which engages the metal border.

DETAILED DESCRIPTION OF PREFERRED EMBODIMENT

Figure 1:
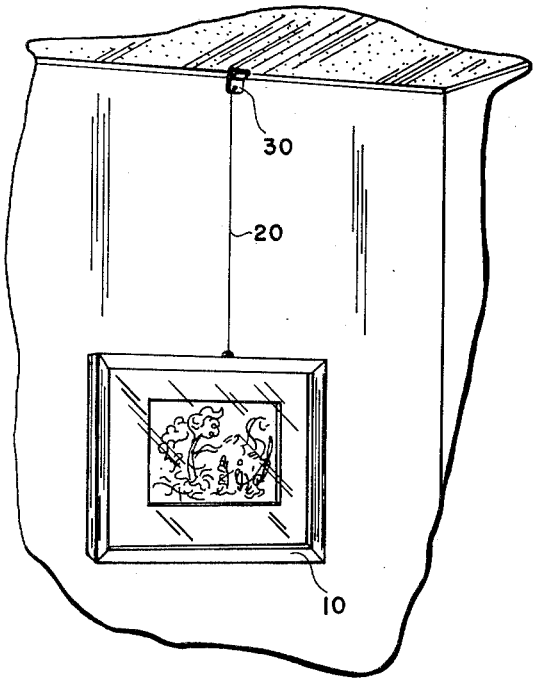
FIG. 1 shows the invention in use.
Figure 4:
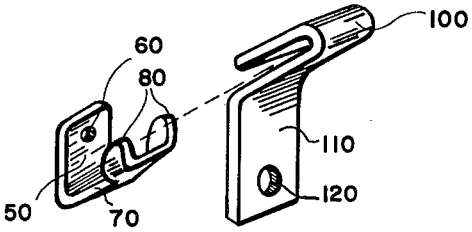
FIG. 4 is an exploded view of the invention.
Figure 5:
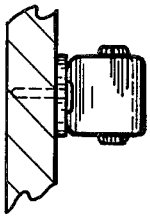
FIG. 5 is a view along line V—V of FIG. 3.

FIG. 1 shows a picture 10 which is hung on wire 20 that is suspended from clip 30. Normally, the picture will be suspended in the manner shown in FIG. 6.

Figure 6:
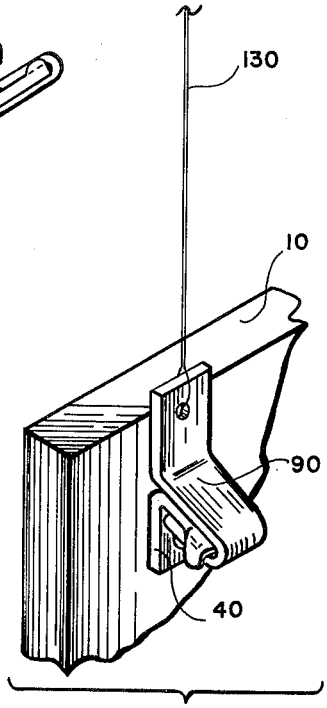
FIG. 6 shows the invention in use on the back of a picture.

FIG. 6 shows a picture 10, with first piece 40 attached to the back of the picture. This piece has a flat plate 50 that is secured flush with the back of the picture by a nail or screw inserted through hole 60 in plate 50. From the top of the plate, flange 70 extends rearwardly and downwardly at an acute angle. Additionally, two opposed tabs 80 extend vertically downwardly from the sides of the flange, at its rear end. A hook 90 engages the first piece to support the picture. The hook has a U-shaped portion 100 that encircles the rear end of flange, lying on both its top end bottom faces. From the forward end of that fare of the hook which lies on the top fare of the flange, a plate 110 extends vertically upwardly, parallel to the rear of the picture. A hole 120 is located in plate 110, to enable a piece of wire or monofilament cable 130 to the tied thereto. It can be seen from FIG. 6 that the purpose of the tabs is to prevent the first piece and the hook from sliding sideways out of alignment.

Figure 3:
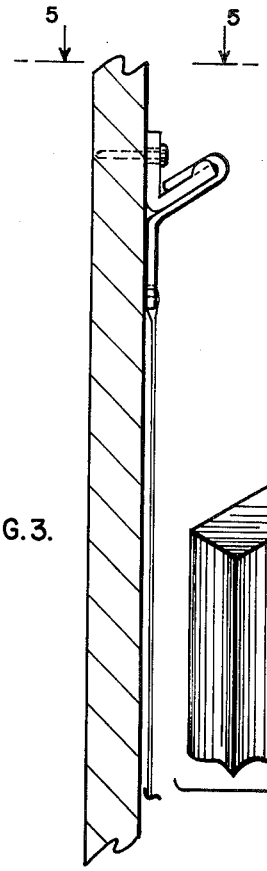
FIG. 3 illustrates the invention as used to support a hanging wire, rather than being supported thereby.

FIG. 3 shows how the invention can be used to support a line for hanging pictures, instead of being supported by such a line. It is to be noted that two units of the invention can be used in combination—one to support a hanging line and the other to be supported by the line.

Figure 2:
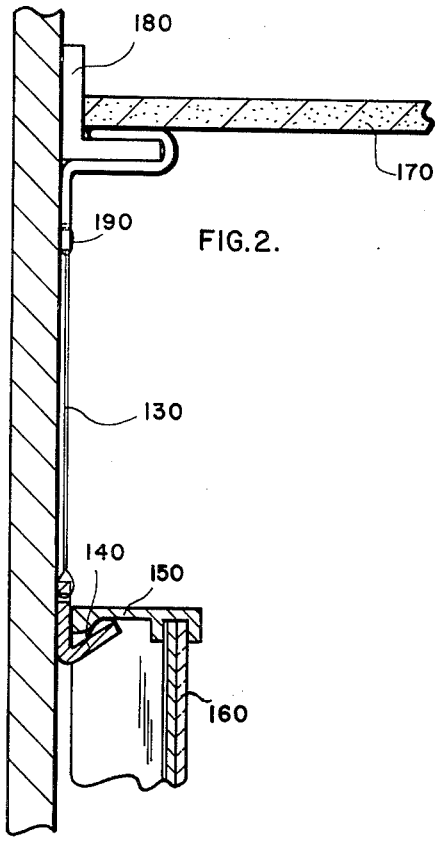
FIG. 2 is a side view of one portion of the invention.

FIG. 2 shows a first piece 140 being used in an inverted position to support a metal section frame 150 of a picture 160. Here, piece 40 is supported by extra wire or monofilament line 130.

FIG. 2 presupposes a suspended ceiling 170 that is kept horizontal by brackets L-shaped in cross-section 180. A clip 190 is clipped over one of these brackets and the line hangs downwardly from the clip. The clip has a structure very similar to the hook, except that the angle between the U-shaped section of the clip and the plate is 90 degrees, and not an obtuse angle, as in the hook.

The first piece 40 of FIG. 6 when used invented as shown in FIG. 3 can be used independently of the second piece 60 to hang mirrors, pictures and the like without additional clips.

While the invention has been described in particular with respect to the drawings, the protection sought is to be limited only by the terms of the claims which follow.

I claim:

1. A device for hanging pictures and the like from a suspended ceiling border framework comprising:

a first piece secured to the rear of the picture and having a flat elongated flange, two opposed tabs and a flat plate, the flat plate being secured to the rear of the picture and having a hole through which a nail and the like may be inserted to secure the first piece to the picture, the flange extending downwardly and rearwardly from the bottom end of the flange, and the tabs extending vertically downwardly from the sides of the flange at its rear end;

a hook, the hook having a U-shaped portion that encircles the rear end of the flange and that lies on the top and bottom faces of the flange, and the hook further having a second portion extending upwardly from the forwardmost end of that face of the U-shaped portion which lies on the top face of the flange, with the second portion being generally parellel to the picture and having a hole;

an elongated vertical wire secured at its lower end to the hook by extending through the hole in the hook; and clip means secured to the upper end of the wire and engaging said framework.

2. The device of claim 1 wherein the clip means is a horizontal U-shaped section with two free ends and a vertically downwardly extending section attached to one of the free ends of the U-shaped section.

* * * * *